US007790014B2

(12) United States Patent
Fray et al.

(10) Patent No.: US 7,790,014 B2
(45) **Date of Patent: *Sep. 7, 2010**

(54) REMOVAL OF SUBSTANCES FROM METAL AND SEMI-METAL COMPOUNDS

(75) Inventors: Derek John Fray, Cambridge (GB); Thomas William Farthing, Birmingham (GB); Zheng Chen, Cambridge (GB)

(73) Assignee: Metalysis Limited (GB)

( * ) Notice: Subject to any disclaimer, the term of this patent is extended or adjusted under 35 U.S.C. 154(b) by 701 days.

This patent is subject to a terminal disclaimer.

(21) Appl. No.: 10/778,529

(22) Filed: Feb. 12, 2004

(65) Prior Publication Data

US 2004/0159559 A1 Aug. 19, 2004

Related U.S. Application Data

(63) Continuation of application No. 09/701,828, filed as application No. PCT/GB99/01781 on Jun. 7, 1999, now Pat. No. 6,712,952.

(30) Foreign Application Priority Data

Jun. 5, 1998 (GB) ..... 9812169.2

(51) Int. Cl.
*C25F 3/00* (2006.01)
*C25C 3/28* (2006.01)

(52) U.S. Cl. ..... 205/640; 205/47; 205/357; 205/358; 205/359; 205/360; 205/361; 205/362; 205/363; 205/364; 205/365; 205/366; 205/367; 205/398; 205/713; 205/717

(58) Field of Classification Search ..... 205/398, 205/47, 357–367, 640, 713, 717
See application file for complete search history.

(56) References Cited

U.S. PATENT DOCUMENTS 568,231 A 9/1896 Blackman
2,707,170 A 4/1955 Wainer (Continued)

FOREIGN PATENT DOCUMENTS

DE 150557 6/1903

(Continued)

OTHER PUBLICATIONS

Habashi, F. "Titanium" In: *Handbook of Extractive Metallurgy*, 1997, pp. 1129-1180, Wiley-VCH, Weinham.

(Continued)

*Primary Examiner*—Alexa D. Neckel
*Assistant Examiner*—Nicholas A. Smith
(74) *Attorney, Agent, or Firm*—Saliwanchik, Lloyd & Saliwanchik

(57) ABSTRACT

The present invention pertains to a method for removing a substance (X) from a solid metal or semi-metal compound ($M^1X$) by electrolysis in a melt of $M^2Y$, which comprises conducting the electrolysis under conditions such that reaction of X rather than $M^2$ deposition occurs at a electrode surface, and that X dissolves in the electrolyte $M^2Y$. The substance X is either removed from the surface (i.e., $M^1X$) or by means of diffusion extracted from the case material. The temperature of the fused salt is chosen below the melting temperature of the metal $M^1$. The potential is chosen below the decomposition potential of the electrolyte.

73 Claims, 3 Drawing Sheets

U.S. PATENT DOCUMENTS

| | | | | | |
|---|---|---|---|---|---|
| 2,909,472 | A | | 10/1959 | Dean | |
| 3,271,277 | A | | 9/1966 | Yntema | |
| 3,778,576 | A | | 12/1973 | Anderson et al. | |
| 4,187,155 | A | | 2/1980 | de Nora et al. | |
| 4,192,724 | A | | 3/1980 | Minami et al. | |
| 4,400,247 | A | | 8/1983 | Ginatta | |
| 4,853,094 | A | | 8/1989 | Honders et al. | |
| 4,875,985 | A | | 10/1989 | Donahue et al. | |
| 4,995,948 | A | | 2/1991 | Poa et al. | |
| 5,015,343 | A | | 5/1991 | La Camera et al. | |
| 5,211,775 | A | | 5/1993 | Fisher et al. | |
| 5,336,378 | A | * | 8/1994 | Nishimura et al. | 205/400 |
| 5,865,980 | A | | 2/1999 | Ray et al. | |
| 6,063,254 | A | * | 5/2000 | Rosenberg et al. | 205/398 |
| 6,074,545 | A | * | 6/2000 | Ginatta | 205/363 |
| 6,117,208 | A | | 9/2000 | Sharma | |

FOREIGN PATENT DOCUMENTS

| | | | |
|---|---|---|---|
| GB | 13759 | | 0/1903 |
| GB | 626636 | | 7/1949 |
| GB | 635267 | | 4/1950 |
| GB | 713446 | | 8/1954 |
| GB | 724198 | | 2/1955 |
| JP | 4099829 | | 3/1992 |
| RU | 2103391 | | 1/1998 |
| WO | WO 89/09290 | A1 | 10/1989 |
| WO | WO 93/15232 | A1 | 8/1993 |
| WO | WO 98/14622 | A1 | 4/1998 |

OTHER PUBLICATIONS

Murray, J. L. et al. "O-Ti (Oxygen-Titanium)" *Binary Allow Phase Diagrams,* 1990, pp. 2924-2927, vol. 3, ASM International, Materials Park.

Kroll, W. J. "The Production of Ductile Titanium" *Trans. Am. Electrochem. Soc.,* 1940, pp. 35-47, vol. 78.

Cobel, G. et al. "Electrowinning of Titanium From Titanium Tetrachloride: Pilot Plant Experience and Production Plant Projections" In: *Titanium '80. Science and Technology. Proc. 4th Int. Conf. Titanium, Kyto,* 1980, pp. 1969-1976, The Mettallurgical Society of AIME, Warrendale.

Opie, W. R. et al. "A Basket Cathode Electrolytic Cell for Production of Titanium Metal" *Trans. Met. Soc. AIME,* 1960, pp. 646-649, vol. 218.

Froes, F. H. "Titanium and Other Light Metals: Let's Do Something About Cost" *JOM,* 1998, p. 15, vol. 50.

Hartmann, A. D. et al. "Producing Lower-Cost Titanium for Automotive Applications" *JOM,* 1998, pp. 16-19, vol. 50.

Suzuki, K. "The High-Quality Precision Casting of Titanium Alloys" *JOM,* 1998, pp. 20-23, vol. 50.

Okabe, T. et al. "The Present Status of Dental Titanium Casting" *JOM,* 1998, pp. 24-29, vol. 50.

Froes, F. H. et al. "The Production of Low-Cost Titanium Powders" *JOM,* 1998, pp. 41-43, vol. 50.

Tapphorn, R. M. et al. "The Solid-State Spray Forming of Low-Oxide Titanium Components" *JOM,* 1998, pp. 45-46, vol. 50.

Elliott, G. R.B. "The Continuous Production of Titanium Powder Using Circulating Molten Salt" *JOM,* 1998, pp. 48-49, vol. 50.

Sohn, H. Y. "Ti and TiAl Powders by the Flash Reduction of Chloride Vapors" *JOM,* 1998, pp. 50-51, vol. 50.

Segall, A. E. et al. "A Cold-Gas Spray Coating Process for Enhancing Titanium" *JOM,* 1998, pp. 52-54, vol. 50.

Larson, H. R. et al. "The Plasma-Enabled Recovery of Titanium by the Electrolysis of Titanate Slags" *JOM,* 1998, pp. 56-57, vol. 50.

McQuillan, A. D. et al. "Reaction of Titanium with Glass" In: *Titanium,* 1956, pp. 402-426, Butterworths Scientific, London.

Ward, R. G. et al. "The Electrolytic Removal of Oxygen, Sulphur, Selenium, and Tellurium from Molten Copper" *Journal of the Institute of Metals,* 1961-1962, pp. 6-12vol. 90.

Sibert, M. E. et al. "Electrolytic Reduction of Titanium Monoxide" *J. Electrochem. Soc.,* 1955, pp. 252-262, vol. 102, No. 5.

"Synopsis of Periodical Literature" In: *Electrochemical and Metallurgical Industry,* Jan. 1905, pp. 35-40.

Hoar, T. P. et al. "The Production of Copper and Sulphur by the Electro-Decomposition of Cuprous Sulphide" *Institution of Mining and Metallurgy,* 1957, pp. 393-410.

Swinkels, A. J. "Advances in Molten Salt Chemistry 1", 1971, pp. 188-191, Plenum Press.

Gray, J. J. et al. "The Chemistry and Metallurgy of Titanium Production" In: *Lectures, Monographs and Reports,* The Royal Institute of Chemistry, 1958, No. 1, London.

Mishra, B et al. "Diffusion Coefficient of Oxygen Ions in Molten Clacium Chloride" 9th Symposium on Molten Salts, *Electrochem. Soc.,* 1994, pp. 697-704.

Mishra, B. et al. "Application of Molten Salts in Pyrochemical Processing of Reactive Metals" *Molten Salts, Electrochem. Soc.,* 1992, pp. 184-203, vol. 92-16, ed. R. J. Gale et al.

Ferro, P.D. et al. "Application of Ceramic Membrane in Molten Salt Electrolysis of $CaO-CaCl_2$" *Waste Management,* 1997; pp. 451-461, vol. 17, No. 7.

Oki, T. et al. "Reduction of Titanium Dioxide by Clacium in Hot Cathode Spot" Memoirs of the Faculty of Engineering, Nagoya University, 1967, pp. 164-166, vol. 19, No. 1.

Delimarskii, J.K. "Chemistry of Ionic Melts", Kiev "Naukova dumka", 1980, pp. 262-264.

Ivanov, A.I. et al. "Electrolysis of $TiO_2$ in Chlorine-Containing Molten Salts" *Titanium and Its Alloys,* 1961, pp. 131-135, vol. 6.

Okabe, T.H. et al. "Production of Niobium Powder by Electronically Mediated Reaction (EMR) Using Clacium as a Reductant" *Journal of Alloys and Compounds,* 1999, pp. 200-210, vol. 288.

Okabe, T.H. et al. "Preparation and Characterization of Extra-low-oxygen Titanium" *Journal of Alloys and Compounds,* 1992, pp. 43-56, vol. 184.

Okabe, T.H. et al. "Deoxidation of Titanium Aluminide by Ca-Al Alloy Under Controlled Aluminum Activity" *Metallurgical Transactions B,* Oct. 1992, pp. 583-590, vol. 23B, No. 5.

Takeuchi, S. et al. "Studies in the Electrolytic Reduction of Titanium Dioxide and Titanium Slag" *Nippon Kinzoku Gakkaishi,* 1964, pp. 549-554, vol. 28, No. 9.

Boghosian, S. et al. "Oxide Complexes in Alkali-Alkaline-Earth Chloride Melts" *Acta Chemica Scandinavica,* 1991, pp. 145-157, vol. 45.

Okabe, T.H. et al. "Electrochemical Deoxidation of Titanium" *Metallurgical Transactions B,* 1993, pp. 449-455, vol. 24B.

Okabe, T.H. et al. "Electrochemical Deoxidation of Yttrium-Oxygen Solid Solutions" *Journal of Alloys and Compounds,* 1996, pp. 150-154, vol. 237.

Ti-O phase diagram, as published in *Phase Diagrams of Binary Titanium Alloys,* 1987 and *Bulletin of Alloy Phase Diagrams,* 8(2), Apr. 1987.

Wyatt, O. and Dew-Hughes, D., *Metals Ceramics and Polymers,* 1974, pp. 42-47.

* cited by examiner

REMOVAL OF SUBSTANCES FROM METAL AND SEMI-METAL COMPOUNDS

This application is a continuation of U.S. application Ser. No. 09/701,828, filed Jan. 22, 2001, now U.S. Pat. No. 6,712,952, which is the national stage of international application No. PCT/GB99/01781, filed Jun. 7, 1999.

FIELD OF INVENTION

This invention relates to a method for reducing the level of dissolved oxygen or other elements from solid metals, metal compounds and semi-metal compounds and alloys. In addition, the method relates to the direct production of metal from metal oxides or other compounds.

BACKGROUND TO THE INVENTION

Many metals and semi-metals form oxides, and some have a significant solubility for oxygen. In many cases, the oxygen is detrimental and therefore needs to be reduced or removed before the metal can be fully exploited for its mechanical or electrical properties. For example, titanium, zirconium and hafnium are highly reactive elements and, when exposed to oxygen-containing environments rapidly form an oxide layer, even at room temperature. This passivation is the basis of their outstanding corrosion resistance under oxidising conditions. However, this high reactivity has attendant disadvantages which have dominated the extraction and processing of these metals.

As well as oxidising at high temperatures in the conventional way to form an oxide scale, titanium and other elements have a significant solubility for oxygen and other metalloids (e.g. carbon and nitrogen) which results in a serious loss of ductility. This high reactivity of titanium and other Group IVA elements extends to reaction with refractory materials such as oxides, carbides etc. at elevated temperatures, again contaminating and embrittling the basis metal. This behaviour is extremely deleterious in the commercial extraction, melting and processing of the metals concerned.

Typically, extraction of a metal from the metal oxide is achieved by heating the oxide in the presence of a reducing agent (the reductant). The choice of reductant is determined by the comparative thermodynamics of the oxide and the reductant, specifically the free energy balance in the reducing reactions. This balance must be negative to provide the driving force for the reduction to proceed.

The reaction kinetics are influenced principally by the temperature of reduction and additionally by the chemical activities of the components involved. The latter is often an important feature in determining the efficiency of the process and the completeness of the reaction. For example, it is often found that although this reduction should in theory proceed to completion, the kinetics are considerably slowed down by the progressive lowering of the activities of the components involved. In the case of an oxide source material, this results in a residual content of oxygen (or another element that might be involved) which can be deleterious to the properties of the reduced metal, for example, in lower ductility, etc. This frequently leads to the need for further operations to refine the metal and remove the final residual impurities, to achieve high quality metal.

Because the reactivity of Group IVA elements is high, and the deleterious effect of residual impurities serious, extraction of these elements is not normally carried out from the oxide, but following preliminary chlorination, by reducing the chloride. Magnesium or sodium are often used as the reductant. In this way, the deleterious effects of residual oxygen are avoided. This inevitably leads, however, to higher costs which make the final metal more expensive, which limits its application and value to a potential user.

Despite the use of this process, contamination with oxygen still occurs. During processing at high temperatures, for example, a hard layer of oxygen-enriched material is formed beneath the more conventional oxide scale. In titanium alloys this is often called the "alpha case", from the stabilising effect of oxygen on the alpha phase in alpha-beta alloys. If this layer is not removed, subsequent processing at room temperature can lead to the initiation of cracks in the hard and relatively brittle surface layer. These can then propagate into the body of the metal, beneath the alpha case. If the hard alpha case or cracked surface is not removed before further processing of the metal, or service of the product, there can be a serious reduction in performance, especially of the fatigue properties. Heat treatment in a reducing atmosphere is not available as a means of overcoming this problem because of the embrittlement of the Group IVA metals by hydrogen and because the oxide or "dissolved oxygen" cannot be reduced or minimised. The commercial costs of getting round this problem are significant.

In practice, for example, metal is often cleaned up after hot working by firstly removing the oxide scale by mechanical grinding, grit-blasting, or using a molten salt, followed by acid pickling, often in $HNO_3$/HF mixtures to remove the oxygen-enriched layer of metal beneath the scale. These operations are costly in terms of loss of metal yield, consumables and not least in effluent treatment. To minimise scaling and the costs associated with the removal of the scale, hot working is carried out at as low a temperature as is practical. This, in itself, reduces plant productivity, as well as increasing the load on the plant due to the reduced workability of the material at lower temperatures. All of these factors increase the costs of processing.

In addition, acid pickling is not always easy to control, either in terms of hydrogen contamination of the metal, which leads to serious embrittlement problems, or in surface finish and dimensional control. The latter is especially important in the production of thin materials such as thin sheet, fine wire, etc.

It is evident therefore, that a process which can remove the oxide layer from a metal and additionally the dissolved oxygen of the sub-surface alpha case, without the grinding and pickling described above, could have considerable technical and economic benefits on metal processing, including metal extraction.

Such a process may also have advantages in ancillary steps of the purification treatment, or processing. For instance, the scrap turnings produced either during the mechanical removal of the alpha case, or machining to finished size, are difficult to recycle due to their high oxygen content and hardness, and the consequent effect on the chemical composition and increase in hardness of the metal into which they are recycled. Even greater advantages might accrue if material which had been in service at elevated temperatures and had been oxidised or contaminated with oxygen could be rejuvenated by a simple treatment. For example, the life of an aero-engine compressor blade or disc made from titanium alloy is constrained, to a certain extent, by the depth of the alpha case layer and the dangers of surface crack initiation and propagation into the body of the disc, leading to premature failure. In this instance, acid pickling and surface grinding are not possible options since a loss of dimension could not be tolerated. A technique which lowered the dissolved oxygen content without affecting the overall dimensions, especially in complex shapes, such as blades or compressor discs, would have obvious and very important economic benefits. Because of the greater effect of temperature on thermodynamic efficiency these benefits would be compounded if they allowed the discs to operate not just for longer times at the same temperature, but also possibly at higher temperatures where greater fuel efficiency of the aeroengine can be achieved.

In addition to titanium, a further metal of commercial interest is Germanium, which is a semi-conducting metalloid element found in Group IVA of the Periodic Table. It is used, in a highly purified state, in infra-red optics and electronics. Oxygen, phosphorus, arsenic, antimony and other metalloids are typical of the impurities which must be carefully controlled in Germanium to ensure an adequate performance. Silicon is a similar semiconductor and its electrical properties depend critically on its purity content. Controlled purity of the parent silicon or germanium is fundamentally important as a secure and reproducible basis, onto which the required electrical properties can be built up in computer chips, etc.

U.S. Pat. No. 5,211,775 discloses the use of calcium metal to deoxidise titanium. Okabe, Oishi and Ono (Met. Trans B. 23B (1992):583, have used a calcium-aluminium alloy to deoxidise titanium aluminide. Okabe, Nakamura, Oishi and Ono (Met. Trans B. 24B (1993):449) deoxidised titanium by electrochemically producing calcium from a calcium chloride melt, on the surface of titanium. Okabe, Devra, Oishi, Ono and Sadoway (Journal of Alloys and Compounds 237 (1996) 150) have deoxidised yttrium using a similar approach.

Ward et al, Journal of the Institute of Metals (1961) 90:612, describes an electrolytic treatment for the removal of various contaminating elements from molten copper during a refining process. The molten copper is treated in a cell with barium chloride as the electrolyte. The experiments show that sulphur can be removed using this process. However, the removal of oxygen is less certain, and the authors state that spontaneous non-electrolytic oxygen loss occurs, which may mask the extent of oxygen removal by this process. Furthermore, the process requires the metal to be molten, which adds to the overall cost of the refining process. The process is therefore unsuitable for a metal such as titanium which melts at 1660° C., and which has a highly reactive melt.

SUMMARY OF INVENTION

According to the present invention, a method for removing a substance (X) from a solid metal or semi-metal compound ($M^1X$) by electrolysis in a melt of $M^2Y$, comprises conducting the electrolysis under conditions such that reaction of X rather than $M^2$ deposition occurs at an electrode surface, and that X dissolves in the electrolyte $M^2Y$.

According to one embodiment of the invention, $M^1X$ is a conductor and is used as the cathode. Alternatively, $M^1X$ may be an insulator in contact with a conductor.

In a separate embodiment, the electrolysis product ($M^2X$) is more stable than $M^1X$.

In a preferred embodiment, $M^2$ may be any of Ca, Ba, Li, Cs or Sr and Y is Cl.

Preferably, $M^1X$ is a surface coating on a body of $M^1$.

In a separate preferred embodiment, X is dissolved within $M^1$.

In a further preferred embodiment, X is any of O, S, C or N.

In a still further preferred embodiment, $M^1$ is any of Ti, Si, Ge, Zr, Hf, Sm, U, Al, Mg, Nd, Mo, Cr, Nb, or any alloy thereof.

In the method of the invention, electrolysis preferably occurs with a potential below the decomposition potential of the electrolyte. A further metal compound or semi-metal compound ($M^NX$) may be present, and the electrolysis product may be an alloy of the metallic elements.

The present invention is based on the realisation that an electrochemical process can be used to ionise the oxygen contained in a solid metal so that the oxygen dissolves in the electrolyte.

When a suitably negative potential is applied in an electrochemical cell with the oxygen-containing metal as cathode, the following reaction occurs:

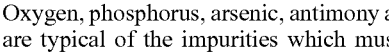

$$O+2e^- \rightleftharpoons O^{2-}$$

The ionised oxygen is then able to dissolve in the electrolyte.

The invention may be used either to extract dissolved oxygen from a metal, i.e. to remove the α case, or may be used to remove the oxygen from a metal oxide. If a mixture of oxides is used, the cathodic reduction of the oxides will cause an alloy to form.

The process for carrying out the invention is more direct and cheaper than the more usual reduction and refining process used currently.

In principle, other cathodic reactions involving the reduction and dissolution of other metalloids, carbon, nitrogen, phosphorus, arsenic, antimony etc. could also take place. Various electrode potentials, relative to $E_{Na}$=O V, at 700° C. in fused chloride melts containing calcium chloride, are as follows:

| | |
|---|---|
| $Ba^2 + 2e^- = Ba$ | −0.314 V |
| $Ca^2 + 2e^- = Ca$ | −0.06 V |
| $Hf^{4+} + 4e^- = Hf$ | 1.092 V |
| $Zr^{4+} + 4e^- = Zr$ | 1.516 V |
| $Ti^{4+} + 4e^- = Ti$ | 2.039 V |
| $Cu^+ + e^- = Cu$ | 2.339 V |
| $Cu^2 + + 2e^- = Cu$ | 2.92 V |
| $O_2 + 4e^- = 20^{2-}$ | 2.77 V |

The metal, metal compound or semi-metal compound can be in the form of single crystals or slabs, sheets, wires, tubes, etc., commonly known as semi-finished or mill-products, during or after production; or alternatively in the form of an artefact made from a mill-product such as by forging, machining, welding, or a combination of these, during or after service. The element or its alloy can also be in the form of shavings, swarf, grindings or some other by-product of a fabrication process. In addition, the metal oxide may also be applied to a metal substrate prior to treatment, e.g. $TiO_2$ may be applied to steel and subsequently reduced to the titanium metal.

DESCRIPTION OF THE INVENTION

In the present invention, it is important that the potential of the cathode is maintained and controlled potentiostatically so that only oxygen ionisation occurs and not the more usual deposition of the cations in the fused salt.

The extent to which the reaction occurs depends upon the diffusion of the oxygen in the surface of the metal cathode. If the rate of diffusion is low, the reaction soon becomes polarised and, in order for the current to keep flowing, the potential becomes more cathodic and the next competing cathodic reaction will occur, i.e. the deposition of the cation from the fused salt electrolyte. However, if the process is allowed to take place at elevated temperatures, the diffusion and ionisation of the oxygen dissolved in the cathode will be sufficient to satisfy the applied currents, and oxygen will be removed from the cathode. This will continue until the potential becomes more cathodic, due to the lower level of dissolved oxygen in the metal, until the potential equates to the discharge potential for the cation from the electrolyte.

This invention may also be used to remove dissolved oxygen or other dissolved elements, e.g. sulphur, nitrogen and carbon from other metals or semi-metals, e.g. germanium, silicon, hafnium and zirconium. The invention can also be used to electrolytically decompose oxides of elements such as titanium, uranium, magnesium, aluminium, zirconium, hafnium, niobium, molybdenum, neodymium, samarium and other rare earths. When mixtures of oxides are reduced, an alloy of the reduced metals will form.

The metal oxide compound should show at least some initial metallic conductivity or be in contact with a conductor.

Figure 1:
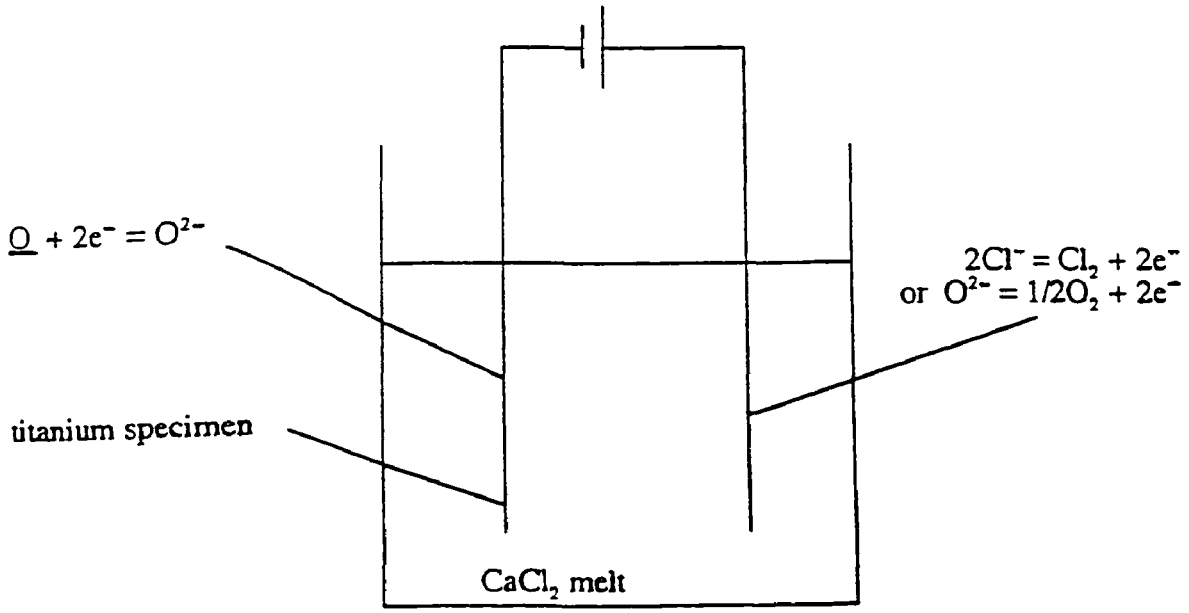
FIG. 1 is a schematic illustration of the apparatus used in the present invention.

An embodiment of the invention will now be described with reference to the drawing, where FIG. 1 shows a piece of titanium made in a cell consisting of an inert anode immersed in a molten salt. The titanium may be in the form of a rod, sheet or other artefact. If the titanium is in the form of swarf or particulate matter, it may be held in a mesh basket. On the application of a voltage via a power source, a current will not start to flow until balancing reactions occur at both the anode and cathode. At the cathode, there are two possible reactions, the discharge of the cation from the salt or the ionisation and dissolution of oxygen. The latter reaction occurs at a more positive potential than the discharge of the metal cation and, therefore, will occur first. However, for the reaction to proceed, it is necessary for the oxygen to diffuse to the surface of the titanium and, depending on the temperature, this can be a slow process. For best results it is, therefore, important that the reaction is carried out at a suitably elevated temperature, and that the cathodic potential is controlled, to prevent the potential from rising and the metal cations in the electrolyte being discharged as a competing reaction to the ionisation and dissolution of oxygen into the electrolyte. This can be ensured by measuring the potential of the titanium relative to a reference electrode, and prevented by potentiostatic control so that the potential never becomes sufficiently cathodic to discharge the metal ions from the fused salt.

The electrolyte must consist of salts which are preferably more stable than the equivalent salts of the metal which is being refined and, ideally, the salt should be as stable as possible to remove the oxygen to as low as concentration as possible. The choice includes the chloride salts of barium, calcium, cesium, lithium, strontium and yttrium. The melting and boiling points of these chlorides are given below:

| | Melting Point (° C.) | Boiling Point (° C.) |
|---|---|---|
| $BaCl_2$ | 963 | 1560 |
| $CaCl_2$ | 782 | >1600 |
| CsCl | 645 | 1280 |

-continued

| | Melting Point (° C.) | Boiling Point (° C.) |
|---|---|---|
| LiCl | 605 | 1360 |
| $SrCl_2$ | 875 | 1250 |
| $YCl_3$ | 721 | 1507 |

Using salts with a low melting point, it is possible to use mixtures of these salts if a fused salt melting at a lower temperature is required, e.g. by utilising a eutectic or near-eutectic mixture. It is also advantageous to have, as an electrolyte, a salt with as wide a difference between the melting and boiling points, since this gives a wide operating temperature without excessive vaporisation. Furthermore, the higher the temperature of operation, the greater will be the diffusion of the oxygen in the surface layer and therefore the time for deoxidation to take place will be correspondingly less. Any salt could be used provided the oxide of the cation in the salt is more stable than the oxide of the metal to be purified.

The following Examples illustrate the invention. In particular, Examples 1 and 2 relate to removal of oxygen from an oxide.

Example 1

A white $TiO_2$ pellet, 5 mm in diameter and 1 mm in thickness, was placed in a titanium crucible filled with molten calcium chloride at 950° C. A potential of 3V was applied between a graphite anode and the titanium crucible. After 5 h, the salt was allowed to solidify and then dissolved in water to reveal a black/metallic pellet. Analysis of the pellet showed that it was 99.8% titanium.

Example 2

A strip of titanium foil was heavily oxidised in air to give a thick coating of oxide (c.50 mm). The foil was placed in molten calcium chloride at 950° C. and a potential of 1.75V applied for 1.5 h. On removing the titanium foil from the melt, the oxide layer had been completely reduced to metal.

Examples 3-5 relate to removal of dissolved oxygen contained within a metal.

Example 3

Commercial purity (CP) titanium sheets (oxygen 1350-1450 ppm, Vickers Hardness Number 180) were made the cathode in a molten calcium chloride melt, with a carbon anode. The following potentials were applied for 3 h at 950° C. followed by 1.5 h at 800° C. The results were as follows:

| V (volt) | Vickers Hardness Number | Oxygen Content |
|---|---|---|
| 3 V | 133.5 | <200 ppm |
| 3.3 V | 103 | <200 ppm |
| 2.8 V | 111 | <200 ppm |
| 3.1 V | 101 | <200 ppm |

The 200 ppm was the lowest detection limit of the analytical equipment. The hardness of titanium is directly related to the oxygen content, and so measuring the hardness provides a good indication of oxygen content.

The decomposition potential of pure calcium chloride at these temperatures is 3.2 V. When polarisation losses and resistive losses are considered, a cell potential of around 3.5V is required to deposit calcium. Since it is not possible for calcium to be deposited below this potential, these results prove that the cathodic reaction is:

$$O+2e^{-}=O^{2-}$$

This further demonstrates that oxygen can be removed from titanium by this technique.

Example 4

A sheet of commercial purity titanium was heated for 15 hours in air at 700° C. in order to form an alpha case on the surface of the titanium.

Figure 2:
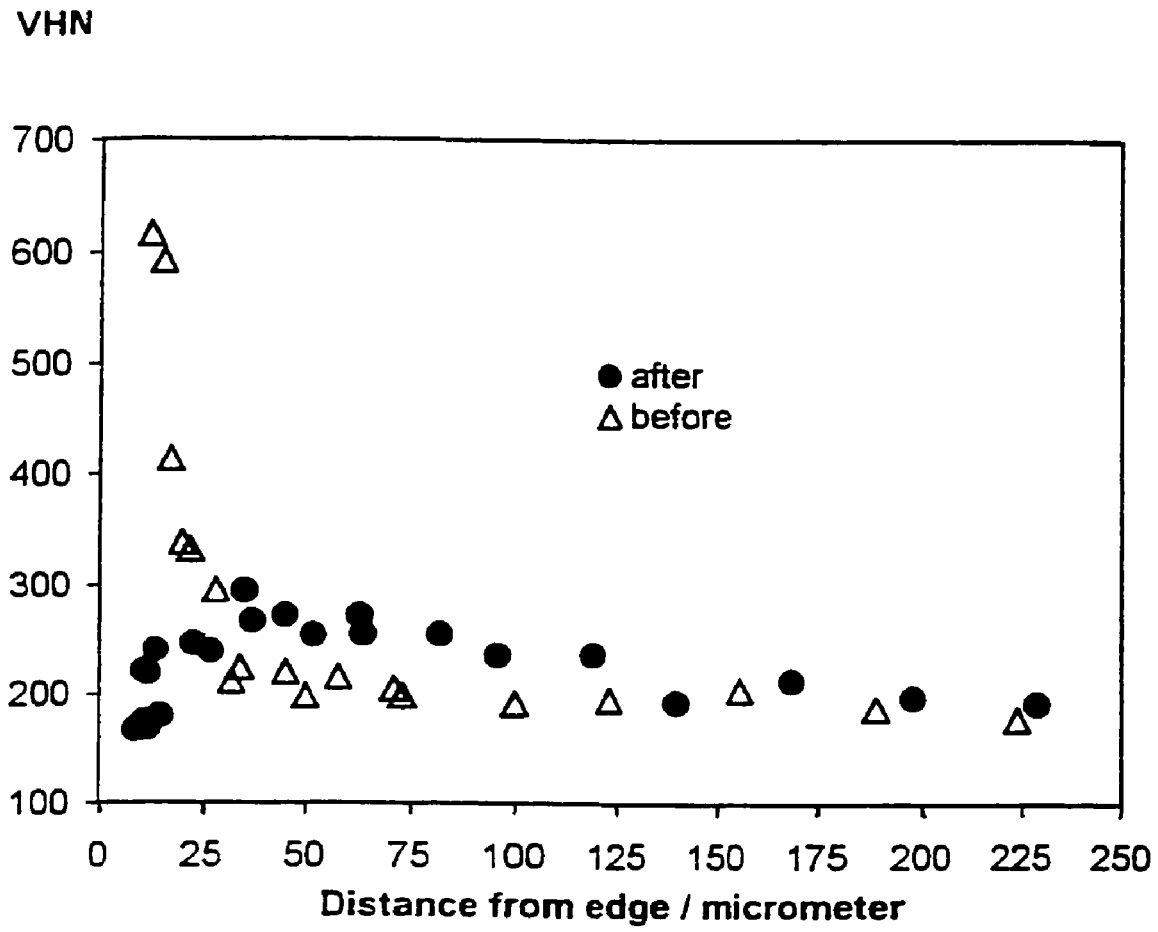
FIG. 2 illustrates the hardness profiles of a surface sample of titanium before and after electrolysis at 3.0 V and 850° C.

After making the sample the cathode in a $CaCl_2$ melt with a carbon anode at 850° C., applying a potential of 3V for 4 hours at 850° C., the alpha case was removed as shown by the hardness curve (FIG. 2), where VHN represents the Vicker's Hardness Number.

Example 5

A titanium 6 Al 4V alloy sheet containing 1800 ppm oxygen was made the cathode in a $CaCl_2$ melt at 950° C. and a cathodic potential of 3V applied. After 3 hours, the oxygen content was decreased from 1800 ppm to 1250 ppm.

Examples 6 and 7 show the removal of the alpha case from an alloy foil.

Example 6

A Ti-6A1-4V alloy foil sample with an alpha case (thickness about 40 μm) under the surface was electrically connected at one end to a cathodic current collector (a Kanthal wire) and then inserted into a $CaCl_2$ melt. The melt was contained in a titanium crucible which was placed in a sealed Inconel reactor that was continuously flushed with argon gas at 950° C. The sample size was 1.2 mm thick, 8.0 mm wide and ~50 mm long. Electrolysis was carried out in a manner of controlled voltage, 3.0V. It was repeated with two different experimental times and end temperatures. In the first case, the electrolysis lasted for one hour and the sample was immediately taken out of the reactor. In the second case, after 3 hours of electrolysis, the temperature of the furnace was allowed to cool naturally while maintaining the electrolysis. When the furnace temperature dropped to slightly lower than 800° C., the electrolysis was terminated and the electrode removed. Washing in water revealed that the 1 hour sample had a metallic surface but with patches of brown colour, whilst the 3 hour sample was completely metallic.

Both samples were then sectioned and mounted in a bakelite stub and a normal grinding and polishing procedure was carried out. The cross section of the samples was investigated by microhardness test, scanning electron microscopy (SEM) and energy dispersive X-ray analysis (EDX). The hardness test showed that the alpha case of both samples disappeared, although the 3 hour sample showed a hardness near the surface much lower than that at the centre of the sample. In addition, SEM and EDX detected insignificant changes in the structure and elemental composition (except for oxygen) in the deoxygenated samples.

Example 7

In a separate experiment, Ti-6A1-4V foil samples as described above (1.2 mm thick, 8 mm wide and 25 mm long) were placed at the bottom of the titanium crucible which functioned as the cathodic current collector. The electrolysis was then carried out under the same conditions as mentioned in Example 6 for the 3-hour sample except that the electrolysis lasted for 4 hours at 950° C. Again using microhardness test, SEM and EDX revealed the successful removal of the alpha case in all the three samples without altering the structure and elemental composition except for oxygen.

Example 8 shows a slip-cast technique for the fabrication of the oxide electrode.

Example 8

A $TiO_2$ powder (anatase, Aldrich, 99.9+% purity; the powder possibly contains a surfactant) was mixed with water to produce a slurry ($TiO_2$:$H_2O$=5:2 wt) that was then slip-cast into a variety of shapes (round pellets, rectangular blocks, cylinders, etc) and sizes (from millimetres to centimeters), dried in room/ambient atmosphere overnight and sintered in air, typically for two hours at 950° C. in air. The resultant $TiO_2$ solid has a workable strength and a porosity of 40~50%. There was notable but insignificant shrinkage between the sintered and unsintered $TiO_2$ pellets.

0.3 g-10 g of the pellets were placed at the bottom of a titanium crucible containing a fresh $CaCl_2$ melt (typically 140 g). Electrolysis was carried out at 3.0V (between the titanium crucible and a graphite rod anode) and 950° C. under an argon environment for 5-15 hours. It was observed that the current flow at the beginning of the electrolysis increased nearly proportionally with the amount of the pellets and followed roughly a pattern of 1 g $TiO_2$ corresponding to 1A initial current flow.

It was observed that the degree of reduction of the pellets can be estimated by the colour in the centre of the pellet A more reduced or metallised pellet is grey in colour throughout, but a lesser reduced pellet is dark grey or black in the centre. The degree of reduction of the pellets can also be judged by placing them in distilled water for a few hours to overnight. The partially reduced pellets automatically break into fine black powders while the metallised pellets remain in the original shape. It was also noticed that even for the metallised pellets, the oxygen content can be estimated by the resistance to pressure applied at room temperature. The pellets became a grey powder under the pressure if there was a high level of oxygen, but a metallic sheet if the oxygen levels were low.

SEM and EDX investigation of the pellets revealed considerable difference in both composition and structure between metallised and partially reduced pellets. In the metallised case, the typical structure of dendritic particles was always seen, and no or little oxygen was detected by EDX. However, the partially reduced pellets were characterised by crystallites having a composition of $Ca_xTi_yO_z$ as revealed by EDX.

Example 9

It is highly desirable that the electrolytic extraction be performed on a large scale and the product removed conveniently from the molten salt at the end of the electrolysis. This may be achieved for example by placing the $TiO_2$ pellets in a basket-type electrode.

The basket was fabricated by drilling many holes (~3.5 mm diameter) into a thin titanium foil (~1.0 mm thickness) which was then bent at the edge to form a shallow cuboid basket with an internal volume of 15×45×45 $mm^3$. The basket was connected to a power supply by a Kanthal wire.

A large graphite crucible (140 mm depth, 70 mm diameter and 10 mm wall thickness) was used to contain the $CaCl_2$ melt. It was also connected to the power supply and functioned as the anode. Approximately 10 g slip-cast $TiO_2$ pellets/blobs (each was about 10 mm diameter and 3 mm maximum thickness) were placed in the titanium basket and lowered into the melt. Electrolysis was conducted at 3.0V, 950° C., for approximately 10 hours before the furnace temperature was allowed to drop naturally. When the temperature reached about 800° C., the electrolysis was terminated. The basket was then raised from the melt and kept in a water-cooled upper part of the Inconel tube reactor until the furnace temperature dropped to below 200° C. before being taken out for analysis.

After acidic leaching (HCl, pH<2) and washing in water, the electrolysed pellets exhibited the same SEM and EDX features as observed above. Some of the pellets were ground into a powder and analysed by thermo-gravitmetry and vacuum fusion elemental analysis. The results showed that the powder contained about 20,000 ppm oxygen.

SEM and EDX analysis showed that, apart from the typical dendritic structure, some crystallites of $CaTiO_x$ (x<3) were observed in the powder which may be responsible for a significant fraction of the oxygen contained in the product. If this is the case, it is expected that upon melting the powder, purer titanium metal ingot can be produced.

An alternative to the basket-type electrode is the use of a "lolly" type $TiO_2$ electrode. This is composed of a central current collector and on top of the collector a reasonably thick layer of porous $TiO_2$. In addition to a reduced surface area of the current collector, other advantages of using a lolly-type $TiO_2$ electrode include: firstly, that it can be removed from the reactor immediately after electrolysis, saving both processing time and $CaCl_2$; secondly, and more importantly, the potential and current distribution and therefore current efficiency can be improved greatly.

Example 10

A slurry of Aldrich anatase $TiO_2$ powder was slip cast into a slightly tapered cylindrical lolly (~20 mm length) comprising a titanium metal foil (0.6 mm thickness, 3 mm width and ~40 mm length) in the centre. After sintering at 950° C., the lolly was connected electrically at the end of the titanium foil to a power supply by a Kanthal wire. Electrolysis was carried out at 3.0V and 950° C. for about 10 hours. The electrode was removed from the melt at about 800° C., washed and leached by weak HCl acid (pH 1-2). The product was then analysed by SEM and EDX. Again, a typical dendritic structure was observed and no oxygen, chlorine and calcium could be detected by EDX.

The slip-cast method may be used to fabricate large rectangular or cylindrical blocks of $TiO_2$ that can then be machined to an electrode with a desired shape and size suitable for industrial processing. In addition, large reticulated $TiO_2$ blocks, e.g. $TiO_2$ foams with a thick skeleton, can also be made by slip casting, and this will help the draining of the molten salt.

The fact that there is little oxygen in a dried fresh $CaCl_2$ melt suggests that the discharge of the chloride anions must be the dominant anodic reaction at the initial stage of electrolysis. This anodic reaction will continue until oxygen anions from the cathode transport to the anode. The reactions can be summarised as follows:

$$\text{anode: } Cl^- = \tfrac{1}{2}Cl_2\uparrow + e$$

$$\text{cathode: } TiO_2 + 4e = Ti + 2O^{2-}$$

$$\text{total: } TiO_2 + 4Cl^- = Ti + 2Cl_2\uparrow + 2O^{2-}$$

When sufficient $O_2$ ions are present the anodic reaction becomes:

$$O^{2-} = \tfrac{1}{2}O_2 + 2e^-$$

and the overall reaction:

$$TiO_2 = Ti + O_2\uparrow$$

Apparently the depletion of chloride anions is irreversible and consequently the cathodically formed oxygen anions will stay in the melt to balance the charge, leading to an increase of the oxygen concentration in the melt. Since the oxygen level in the titanium cathode is in a chemical equilibrium or quasi-equilibrium with the oxygen level in the melt for example via the following reaction:

| | |
|---|---|
| $Ti + CaO = TiO + Ca$ | $K(950° C.) = 3.28 \times 10^{-4}$ |

It is expected that the final oxygen level in the electrolytically extracted titanium cannot be very low if the electrolysis proceeds in the same melt with controlling the voltage only.

This problem can be solved by (1) controlling the initial rate of the cathodic oxygen discharge and (2) reducing the oxygen concentration of the melt. The former can be achieved by controlling the current flow at the initial stage of the electrolysis, for example gradually increasing the applied cell voltage to the desired value so that the current flow will not go beyond a limit. This method may be termed "double-controlled electrolysis". The latter solution to the problem may be achieved by performing the electrolysis in a high oxygen level melt first, which reduces $TiO_2$ to the metal with a high oxygen content, and then transferring the metal electrode to a low oxygen melt for further electrolysis. The electrolysis in the low oxygen melt can be considered as an electrolytic refining process and may be termed "double-melt electrolysis".

Example 11 illustrates the use of the "double-melt electrolysis" principle.

Example 11

A $TiO_2$ lolly electrode was prepared as described in Example 10. A first electrolysis step was carried out at 3.0V, 950° C. overnight (~12 hours) in re-melted $CaCl_2$ contained within an alumina crucible.

A graphite rod was used as the anode. The lolly electrode was then transferred immediately to a fresh $CaCl_2$ melt contained within a titanium crucible. A second electrolysis was then carried out for about 8 hours at the same voltage and temperature as the first electrolysis, again with a graphite rod as the anode. The lolly electrode was removed from the reactor at about 800° C., washed, acid leached and washed again in distilled water with the aid of an ultrasonic bath. Again both SEM and EDX confirmed the success in extraction.

Thermo-weight analysis was applied to determine the purity of the extracted titanium based on the principle of re-oxidation. About 50 mg of the sample from the lolly electrode was placed in a small alumina crucible with a lid and heated in air to 950° C. for about 1 hour. The crucible containing the sample was weighted before and after the heating and the weight increase was observed. The weight increase was then compared with the theoretical increase when pure titanium is oxidised to titanium dioxide. The result showed that the sample contained 99.7+% of titanium, implying less than 3000 ppm oxygen.

Example 12

The principle of this invention can be applied not only to titanium but also other metals and their alloys. A mixture of $TiO_2$ and $Al_2O_3$ powders (5:1 wt) was slightly moistened and pressed into pellets (20 mm diameter and 2 mm thickness) which were later sintered in air at 950° C. for 2 hours. The sintered pellets were white and slightly smaller than before sintering. Two of the pellets were electrolysed in the same way as described in Example 1 and Example 3. SEM and EDX analysis revealed that after electrolysis the pellets changed to the Ti—Al metal alloy although the elemental distribution in the pellet was not uniform: the Al concentration was higher in the central part of the pellet than near the surface, varying from 12 wt % to 1 wt %. The microstructure of the Ti—Al alloy pellet was similar to that of the pure Ti pellet.

Figure 3:
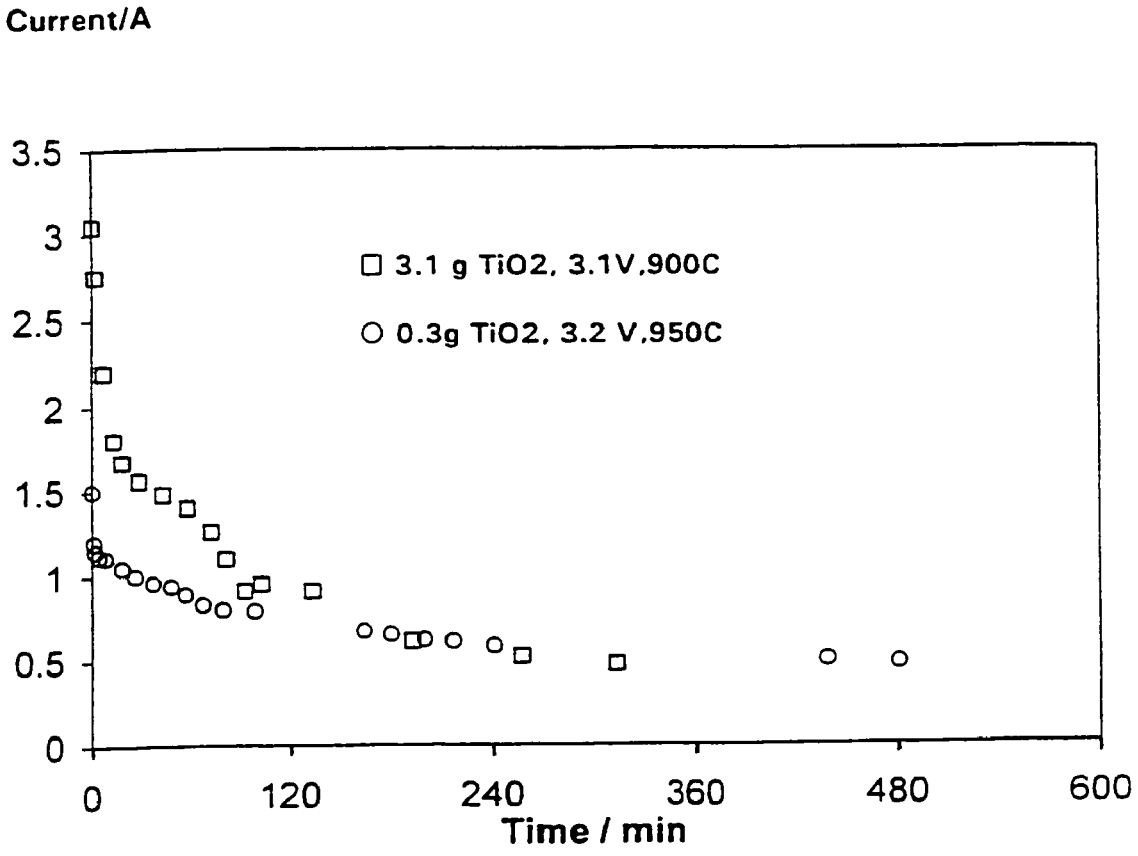
FIG. 3 illustrates the difference in currents for electrolytic reduction of $TiO_2$ pellets under different conditions.

FIG. 3 shows the comparison of currents for the electrolytic reduction of $TiO_2$ pellets under different conditions. It can be shown that the amount of current flowing is directly proportional to the amount of oxide in the reactor. More importantly, it also shows that the current decreases with time and therefore it is probably the oxygen in the dioxide that is ionising and not the deposition of calcium. If calcium was being deposited, the current should remain constant with time.

We claim:

1. A method for decomposing a solid compound by removing a substance (X) from the solid compound ($M^1X$) between the substance and a metal or semi-metal ($M^1$), comprising the steps of:

(a) providing the solid compound in the form of a powder and forming the powder into a predetermined shape;

(b) arranging a cathode comprising the solid compound, in the predetermined shape, in contact with an electrolyte ($M^2Y$) comprising a fused salt;

(c) arranging an anode in contact with the electrolyte; and (d) decomposing said solid compound by applying a cell potential of 3.5V or less between the cathode and the anode such that the substance dissolves in the electrolyte.

2. The method according to claim 1, wherein the cathode in step (a) consists of the solid compound in contact with the electrolyte ($M^2Y$) comprising the fused salt.

3. A method for decomposing a solid compound by removing a substance (X) from the solid compound ($M^1X$) between the substance and a metal or semi-metal ($M^1$), wherein the solid compound is an insulator, comprising the steps of:

(a) providing the solid compound in the form of a powder and forming the powder into a predetermined shape;

(b) arranging a cathode comprising the solid compound, in the predetermined shape, in contact with an electrolyte ($M^2Y$) comprising a fused salt;

(c) arranging an anode in contact with the electrolyte; and (d) decomposing said solid compound by applying a voltage between the cathode and the anode such that the substance dissolves in the electrolyte.

4. The method according to claim 3, wherein the cathode in step (a) consists of the solid compound in contact with the electrolyte ($M^2Y$) comprising the fused salt.

5. A method for decomposing a solid compound by removing a substance (X) from the solid compound ($M^1X$) between the substance and a metal or semi-metal ($M^1$), comprising the steps of:

(a) providing the solid compound in the form of a powder and forming the powder into a predetermined shape;

(b) arranging a cathode comprising the solid compound, in the predetermined shape, in contact with an electrolyte ($M^2Y$) comprising a fused salt, the electrolyte comprising a cation ($M^2$);

(c) arranging an anode in contact with the electrolyte; and (d) decomposing said solid compound by applying a voltage between the cathode and the anode such that the substance dissolves in the electrolyte and such that the metal or semi-metal produced by the method contains substantially no deposit of metal from the discharge of the cation from the electrolyte.

6. The method according to claim 5, wherein the cathode in step (a) consists of the solid compound in contact with the electrolyte ($M^2Y$) comprising the fused salt.

7. The method according to claim 1, 3, or 5, wherein the cathode comprises the solid compound in contact with a conductor, the solid compound being held in the conductor.

8. The method according to claim 1, 3, or 5, wherein the cathode is formed from the solid compound in powdered form by slip-casting and/or sintering.

9. A method for decomposing a solid compound by removing a substance (X) from the solid compound ($M^1X$) between the substance and a metal or semi-metal ($M^1$), comprising the steps of:

(a) arranging a cathode, comprising the solid compound in sintered form, in contact with an electrolyte ($M^2Y$) comprising a fused salt;

(b) arranging an anode in contact with the electrolyte; and (c) decomposing said solid compound by applying a voltage between the cathode and the anode such that the substance dissolves in the electrolyte.

10. The method according to claim 9, wherein the cathode in step (a) consists of the solid compound in sintered form held in or by the conductor, in contact with the electrolyte ($M^2Y$) comprising the fused salt.

11. The method according to claim 1, 3, 5, or 9, wherein the cathode comprises the solid compound, in the predetermined shape, in contact with a conductor, in which the conductor is in the form of a basket.

12. The method according to claim 1, 3, 5, or 9, wherein the cathode comprises the solid compound, in the predetermined shape, in contact with a conductor, in which the conductor is in the form of a crucible.

13. The method according to claim 1, 5, or 9, wherein the solid compound is an insulator.

14. The method according to claim 1, 3, 5, or 9, wherein the solid compound is in the form of a porous pellet.

15. The method according to claim 1, 3, 5, or 9, wherein the metal or semi-metal comprises Ti.

16. The method according to claim 1, 3, 5, or 9, wherein the metal or semi-metal comprises one or more selected from the group consisting of Si, Ge, Zr, Hf, Sm, U, Al, Mg, Nd, Mo, Cr and Nb.

17. The method according to claim 1, 3, 5, or 9, wherein the substance is selected from the group consisting of O, S, C and N.

18. The method according to claim 1, 3, 5, or 9, wherein a further metal compound or semi-metal compound ($M^NX$) is present, and the electrolysis product is an alloy of the metals and/or semi-metals.

19. The method according to claim 18, wherein the solid compounds are sintered before being contacted with the electrolyte.

20. The method according to claim 1, 3, 5, or 9, wherein a metal, semi-metal or alloy produced by the method comprises one or more selected from the group consisting of Ti, Si, Ge, Zr, I-If, Sm, U, Al, Mg, Nd, Mo, Cr, and Nb.

21. The method according to claim 1, 3, 5, or 9, wherein the electrolyte comprises a cation ($M^2$) selected from the group consisting of Ca, Ba, Li, Sr and Cs, and the metal or semi-metal produced by the method contains substantially no deposited Ca, Ba, Li, Sr or Cs, respectively.

22. The method according to claim 1, 3, 5, or 9, wherein electrolysis is carried out at a temperature from 700° C. to 1000° C.

23. The method according to claim 1, 3, 5, or 9, wherein the electrolyte comprises a cation ($M^2$) selected from the group consisting of Ca, Ba, Li, Cs and Sr; and/or the electrolyte comprises an anion (Y), which is Cl.

24. The method according to claim 1, 3, 5, or 9, wherein at an initial stage of electrolysis an applied cell voltage is gradually increased to a desired value so that the current flow at the initial stage of electrolysis does not exceed a predetermined limit.

25. The method according to claim 1, 3, 5, or 9, wherein electrolysis is carried out in two stages, an electrolyte provided in a second stage containing a lower concentration of the substance (X) than an electrolyte provided in a previous stage.

26. The method according to claim 1, 3, 5, or 9, wherein electrolysis occurs with a potential below the decomposition potential of the electrolyte.

27. The method according to claim 1, 3, 5, or 9, wherein the electrolyte comprises a cation ($M^2$) and the method comprises conducting the electrolysis under conditions such that reaction of the substance rather than deposition of the cation occurs at the cathode surface.

28. The method according to claim 1, 3, 5, or 9, in which the electrolyte comprises $CaCl_2$ and CaO.

29. A method for forming an alloy of two or more metal or semi-metal components ($M^1$, $M^N$) comprising the steps of:

(a) providing solid compounds ($M^1X$, $M^NZ$) of each of the components with another substance or substances (X, Z), each solid compound being in the form of a powder;
(b) mixing the powders of the solid compounds together;
(c) providing an electrolyte ($M^2Y$) comprising a fused salt;
(d) arranging a cathode comprising the mixed powders of the solid compounds in contact with the electrolyte;
(e) arranging an anode in contact with the electrolyte; and
(f) applying a voltage between the cathode and the anode such that the substance or substances dissolve(s) in the electrolyte.

30. The method according to claim 29, wherein the cathode in step (d) consists of the mixed solid compounds in contact with the electrolyte ($M^2Y$) comprising the fused salt.

31. The method according to claim 29, wherein a cell potential of 3.5V or less is applied between the cathode and the anode.

32. The method according to claim 29, wherein the electrolyte comprises a cation ($M^2$), and the voltage applied between the cathode and the anode is such that the alloy produced by the method contains substantially no deposition of the cation from the electrolyte.

33. A method for forming an alloy of two or more metal or semi-metal components ($M^1$, $M^N$), comprising the steps of:

(a) providing solid compounds ($M^1X$, $M^NZ$) of each of the components with another substance or substances (X, Z), each solid compound being in the form of a powder, at least one of the compounds being an insulator;
(b) mixing the powders of the solid compounds together;
(c) providing an electrolyte ($M^2Y$) comprising a fused salt;
(d) arranging a cathode comprising the mixed powders of the solid compounds in contact with the electrolyte;
(e) arranging an anode in contact with the electrolyte; and
(f) applying a voltage between the cathode and the anode such that the substance or substances dissolve(s) in the electrolyte.

34. The method according to claim 33, wherein the cathode in step (d) consists of the mixed solid compounds in contact with the electrolyte ($M^2Y$) comprising the fused salt.

35. The method according to claim 29 or 33, wherein the cathode comprises the mixed solid compounds in contact with a conductor, the mixed solid compounds being held in the conductor.

36. The method according to claim 29 or 33, wherein the mixed powders of the solid compounds are sintered before being contacted with the electrolyte.

37. A method for forming an alloy of two or more metal or semi-metal components ($M^1$, $M^N$), comprising the steps of:

(a) providing solid compounds ($M^1X$, $M^NZ$) of each of the components with another substance or substances (X, Z), each solid compound being in the form of a powder;
(b) mixing and sintering the powders of the solid compounds together;
(c) providing an electrolyte ($M^2Y$) comprising a fused salt;
(d) arranging a cathode, comprising the sintered powders of the solid compounds held in or by a conductor, in contact with an electrolyte;
(e) arranging an anode in contact with the electrolyte; and
(f) applying a voltage between the cathode and the anode such that the substance or substances dissolve(s) in the electrolyte.

38. The method according to claim 37, wherein the cathode in step (d) consists of the sintered solid compound held in or by the conductor, in contact with the electrolyte ($M^2Y$) comprising the fused salt.

39. The method according to claim 37, in which the conductor is in the form of a basket.

40. The method according to claim 37, wherein the conductor is in the form of a crucible.

41. The method according to claim 29, 33, or 37, wherein at least one of the solid compound is an insulator.

42. The method according to claim 29, 33, or 37, wherein the mixed powders of the solid compounds are in the form of a porous pellet.

43. The method according to claim 29, 33, or 37, wherein the alloy comprises Ti.

44. The method according to claim 29, 3, or 37, wherein the alloy comprises one or more selected from the group consisting of Si, Ge, Zr, Hf, Sm, U, Al, Mg, Nd, Mo, Cr and Nb.

45. The method according to claim 29, 33, or 37, wherein the substance is selected from the group consisting of O, S, C and N.

46. The method according to claim 29, 33, or 37, wherein at least one of the metal or semi-metal components comprises one or more selected from the group consisting of Ti, Si, Ge, Zr, Hf, Sm, U, Al, Mg, Nd, Mo, Cr, and Nb.

47. The method according to claim 29, 33, or 37, wherein the electrolyte comprises a cation ($M^2$) selected from the group consisting of Ca, Ba, Li, Sr and Cs, and the alloy produced by the method contains substantially no deposited Ca, Ba, Li, Sr or Cs, respectively.

48. The method according to claim 29, 33, or 37, wherein electrolysis is carried out at a temperature from 700° C. to 1000° C.

49. The method according to claim 39, 33, or 37, wherein the electrolyte comprises a cation ($M^2$) selected from the group consisting of Ca, Ba, Li, Cs and Sr; and/or the electrolyte comprises an anion (Y), which is Cl.

50. The method according to claim 29, 33, or 37, wherein at an initial stage of electrolysis an applied cell voltage is gradually increased to a desired value so that the current flow at the initial stage of electrolysis does not exceed a predetermined limit.

51. The method according to claim 29, 33, or 37, wherein electrolysis is carried out in two stages, an electrolyte provided in a second stage containing a lower concentration of the substance (X) than an electrolyte provided in a previous stage.

52. The method according to claim 29, 33, or 37, wherein electrolysis occurs with a potential below the decomposition potential of the electrolyte.

53. The method according to claim 29, 33, or 37, wherein the electrolyte comprises a cation ($M^2$) and the method comprises conducting the electrolysis under conditions such that reaction of the substance rather than deposition of the cation occurs at the cathode surface.

54. The method according to claim 29, 33, or 37, wherein the electrolyte comprises $CaCl_2$ and CaO.

55. A method for fabricating a product, comprising the steps of:

(a) providing a solid compound between a substance (X) and a metal or semi-metal ($M^1$), the solid compound being in the form of a powder;

(b) forming from said powder an artefact of a predetermined shape for treatment by electrolysis to produce an electrolysis product; and (c) conducting the electrolysis by arranging a cathode comprising the artefact in contact with an electrolyte ($M^2Y$) comprising a fused salt, arranging an anode in contact with the electrolyte and applying a voltage between the cathode and the anode such that the substance dissolves in the electrolyte, the electrolysis product remaining in the original shape.

56. The method according to claim 55, wherein the artefact is of a form selected from the group consisting of a semi-finished product, a mill-product, a single crystal, a slab, a sheet, a wire, a tube, a rod, a pellet, a foil, a rectangular block, a cylinder, a lolly, a cylindrical block, a reticulated block, a foam or a powder.

57. The method according to claim 55, wherein the artefact comprises a metal oxide applied to a metal substrate.

58. The method according to claim 55, wherein the artefact is porous.

59. The method according to claim 55, wherein the metal or semi-metal comprises one or more selected from the group of Ti, Si, Ge, Zr, Hf, Sm, U, Al, Mg, Nd, Mo, Cr and Nb.

60. The method according to claim 55, wherein the electrolysis product comprises, or is an alloy of, one or more selected from the group of Ti, Si, Ge, Zr, Hf, Sm, U, Al, Mg, Nd, Mo, Cr and Nb.

61. The method according to claim 55, wherein the artefact is formed by slip-casting and/or sintering and/or machining.

62. The method according to claim 55, comprising the step of crushing or grinding the electrolysis product to form a powder.

63. The method according to claim 55, wherein the electrolysis does not affect the overall dimensions of the artefact.

64. The method according to claim 55, wherein the artefact is placed in an electrically-conducting basket or crucible during the electrolysis.

65. A method for fabricating a product, comprising the steps of:

(a) providing a solid compound between a substance (X) and a metal or semi-metal ($M^1$), the solid compound being in the form of a powder;

(b) forming from said powder an electrode with a desired or predetermined shape for treatment by electrolysis to produce an electrolysis product; and (c) conducting the electrolysis by arranging the electrode in contact with an electrolyte ($M^2Y$) comprising a fused salt, arranging an anode in contact with the electrolyte and applying a voltage between the electrode and the anode such that the substance dissolves in the electrolyte, the electrolysis product remaining in the original shape.

66. The method according to claim 65, wherein the electrode is of a form selected from the group comprising a semi-finished product, a mill-product, a single crystal, a slab, a sheet, a wire, a tube, a rod, a pellet, a foil, a rectangular block, a cylinder, a lolly, a cylindrical block, a reticulated block, a foam or a powder.

67. The method according to claim 65, wherein the electrode is porous.

68. The method according to claim 65, wherein the metal or semi-metal comprises one or more selected from the group of Ti, Si, Ge, Zr, Hf, Sm, U, Al, Mg, Nd, Mo, Cr and Nb.

69. The method according to claim 65, wherein the electrolysis product comprises, or is an alloy of, one or more of Ti, Si, Ge, Zr, Hf, Sm, U, Al, Mg, Nd, Mo, Cr and Nb.

70. The method according to claim 65, wherein the electrode is formed by slip-casting and/or sintering and/or machining.

71. The method according to claim 65, comprising the step of crushing or grinding the electrolysis product to form a powder.

72. The method according to claim 65, wherein the electrolysis does not affect the overall dimensions of the electrode.

73. The method according to claim 65, wherein the electrode is placed in an electrically-conducting basket or crucible during the electrolysis.

* * * * *

UNITED STATES PATENT AND TRADEMARK OFFICE

CERTIFICATE OF CORRECTION

PATENT NO. : 7,790,014 B2
APPLICATION NO. : 10/778529
DATED : September 7, 2010
INVENTOR(S) : Derek John Fray, Thomas William Farthing and Zheng Chen It is certified that error appears in the above-identified patent and that said Letters Patent is hereby corrected as shown below:

Column 3,
Line 31, "90:612" should read --90: 6-12--.

Column 10,
Line 1, "sufficient $O_2$" should read --sufficient $O^{2-}$--.

Column 12,
Line 67, "Zr, I-IF, Sm" should read --Zr, Hf, Sm--.

Column 14,
Line 44, "claim 29, 3, or 37" should read --claim 29, 33, or 37--.

Signed and Sealed this
Twenty-fifth Day of January, 2011

David J. Kappos

David J. Kappos
*Director of the United States Patent and Trademark Office*